United States Patent [19]

Gillum et al.

[11] 4,011,622

[45] Mar. 15, 1977

[54] ATTACHMENT FOR A ROLLER APPLICATOR

[75] Inventors: Charles A. Gillum, Hoffman Estates; Theodore J. Kalata, Schaumburg, both of Ill.

[73] Assignee: Kagil Corporation, Hoffman Estates, Ill.

[22] Filed: Oct. 14, 1975

[21] Appl. No.: 622,751

[52] U.S. Cl. ..... 15/248 A

[51] Int. Cl.[2] ..... B05C 17/02

[58] Field of Search ..... 15/27, 230.11, 248 A, 15/257.06; 101/328–331; 401/21, 147, 197, 208, 218–220

[56] References Cited

UNITED STATES PATENTS

| | | | |
|---|---|---|---|
| 2,902,706 | 9/1959 | Gaetke | 15/248 A |
| 3,112,729 | 12/1963 | Prezioso | 15/230.11 |
| 3,133,548 | 5/1964 | Carr | 134/149 X |
| 3,457,582 | 7/1969 | Fisher | 15/248 A |
| 3,748,683 | 7/1973 | Smith | 15/248 A |

FOREIGN PATENTS OR APPLICATIONS

| | | | |
|---|---|---|---|
| 1,529,912 | 5/1968 | France | 15/248 A |

*Primary Examiner*—Daniel Blum
*Attorney, Agent, or Firm*—Biebel, French & Nauman

[57] ABSTRACT

An attachment for a paint roller pad includes a semi-cylindrical shield and a plurality of slotted clips to permit the shield to be positioned with respect to a paint roller pad by using one of the clips to attach the shield to the paint roller. Each of the slotted clips define a slot which is parallel to the central axis of the semi-cylindrical shield. A plurality of additional attachment members are positioned along an arcuate edge of the shield.

2 Claims, 7 Drawing Figures

FIG-1
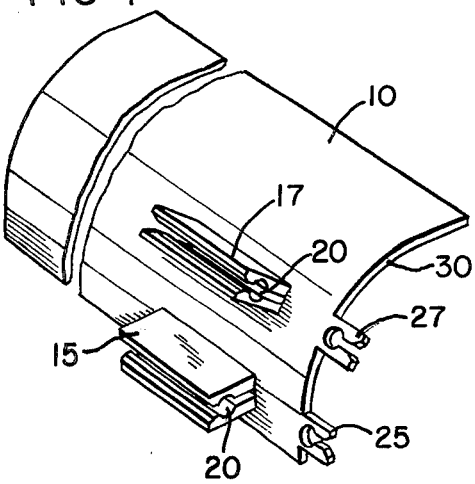
FIG-2
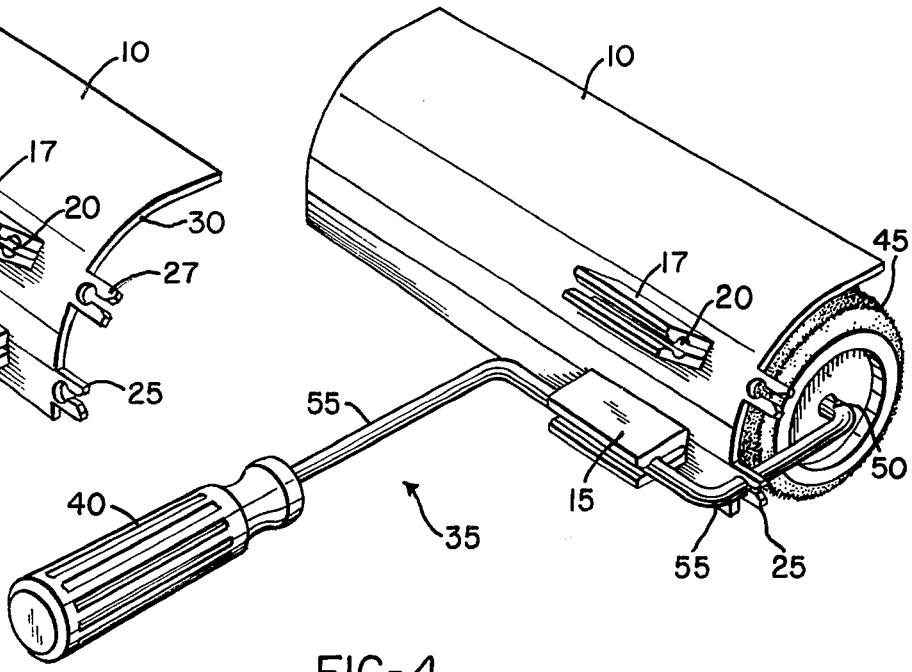
FIG-4
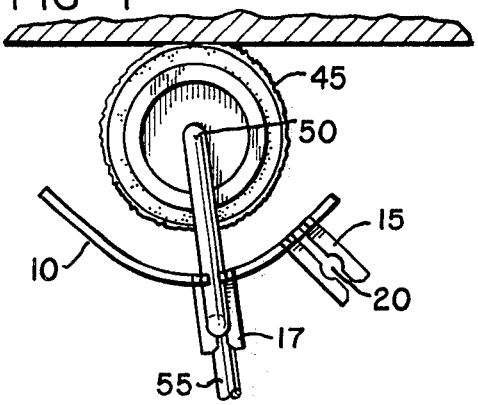
FIG-3
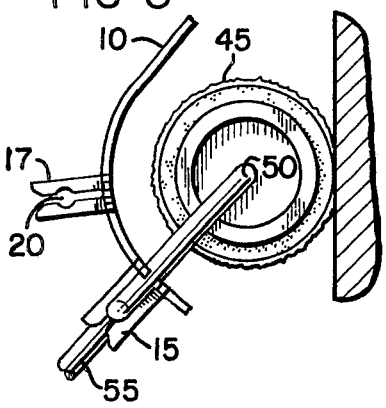
FIG-7
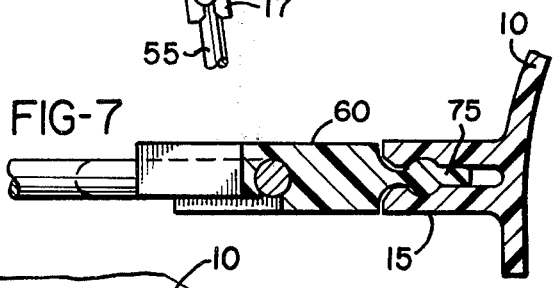
FIG-5
FIG-6
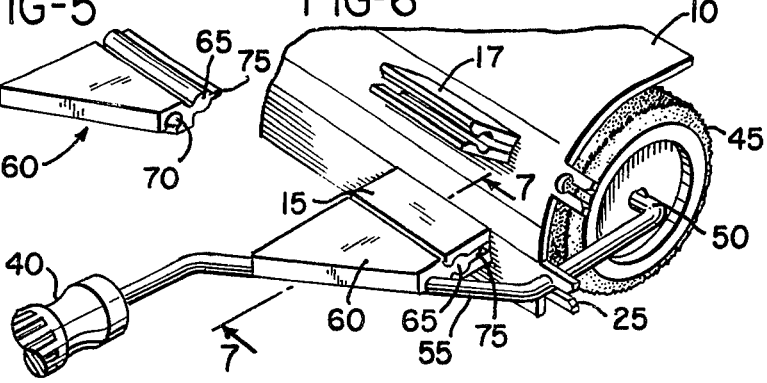

ATTACHMENT FOR A ROLLER APPLICATOR

BACKGROUND OF THE INVENTION

This invention relates to an attachment for a roller applicator and more particularly for a roller applicator of the type generally used to apply paint.

In the past it has been known to apply paint by means of a roller type pad. This type of applicator is generally superior to a conventional paint brush in coating large, relatively smooth surface areas. Paint roller application allows for a smooth uniform coat of paint and minimizes brush marks. Use of an appropriately textured roller pad allows various surfaces to be painted and even permits the application of paint to create surfaces of varying textures.

While having many advantages over paint brushes of the conventional type, paint rollers tend to splatter during the application process. This is true particularly when a paint of relatively thin consistency is applied and the paint roller is moved rapidly across the surface, spinning the roller rapidly. This splatter is undesirable in painting walls and is even more objectionable when ceilings are painted, since the painter, standing directly beneath the roller, will received much of the splattering.

A number of attempts have been made to reduce undesirable splattering by attaching a shield to the roller applicator. One such shield is shown in U.S. Pat. No. 3,457,582, issued on July 29, 1969, to Fisher. The shield is slidably mounted on a mounting plate which is attached to the handle of the roller applicator. By sliding the plate with respect to the shield, the shield may be properly positioned for painting both walls and ceilings. U.S. Pat. No. 3,538,532 issued Nov. 10, 1970, to Schartino et al also shows a guard or shield attachable to a paint roller brush. The shield there disclosed includes an out-turned portion or flange which defines a trough beneath the roller to collect drippings. U.S. Pat. No. 3,825,970, issued July 30, 1974, to Hanssen discloses a shield which is integrally formed with a roller handle and a roller spindle. None of the prior art devices have been entirely satisfactory. Most have been complicated to make, difficult to clean after use, and many of the various types of shields have not been adjustable so that they were effective only in painting walls or in painting ceilings.

SUMMARY OF THE INVENTION

In accordance with the present invention, an attachment for a roller pad paint applicator to prevent splattering of paint during application by the paint roller comprises a generally semi-cylindrical shield curved about a central axis. The paint roller has a handle portion, a cylindrical pad rotatable about a spindle and an arm connecting the spindle to the handle. The attachment further includes a plurality of clip means which attach the shield to the arm of the paint roller so that the central axis of the shield is parallel with the spindle. The clip means include slotted members which are integrally formed with the shield and extend radially therefrom. Each slotted member defines a slot parallel to the central axis of the semi-cylindrical shield. Adjustment of the attachment is accomplished by connecting the shield to the arm of the paint roller with a different one of the clip means. Each of the clips means further includes an additional attachment member located on an arcuate edge of the shield which also attaches to the arm. An adapter is provided to allow the attachment to be secured to variously configured paint rollers.

Accordingly, it is an object of this invention to provide an attachment for a roller pad applicator which is easily constructed and which permits rapid clean up after use; to provide such an attachment in which a plurality of clip means are available to secure the attachment to the roller; and to provide an adapter which may cooperate with the clip means to secure the attachment to paint rollers of varying construction.

Other objects and advantages of the present invention will be apparent from the following description, the accompanying drawings and the appended claims.

BRIEF DESCRIPTION OF THE DRAWINGS

FIG. 1 is a perspective of the preferred embodiment of the invention with a portion of the length broken away;

FIG. 2 is a perspective view of the preferred embodiment showing the manner of attachment to a paint roller;

FIG. 3 is an end elevation showing the preferred embodiment of the invention and a portion of the paint roller during application of paint to a wall surface;

FIG. 4 is an end elevation showing the preferred embodiment of the invention and a portion of the paint roller during application of paint to a ceiling surface;

FIG. 5 is a perspective view showing an adapter for use with a preferred embodiment of the invention;

FIG. 6 is a fragmentary perspective showing the manner of use of the adapter of FIG. 5; and FIG. 7 is a section of the preferred embodiment of the invention and adapter taken generally along line 7—7 of FIG. 6.

DETAILED DESCRIPTION OF THE PREFERRED EMBODIMENT

Referring now to FIG. 1, there is shown the preferred embodiment of the invention in perspective with a portion of the length broken away. The attachment comprises a generally semi-cylindrical shield 10 which is curved about a central axis. A plurality of clip means are provided for attaching the shield to a paint roller. Each clip means includes a spotted member 15, 17 which is formed integrally with shield 10 and extends radially from the shield. Each of the slotted members defines a slotted opening 20, which opening is parallel to the central axis of the shield 10. Each of the clip means includes an additional attachment member 25, 27 which is positioned along an arcuate edge 30 of the shield 10. The shield and clip means may be simply fabricated as a unitary piece from molded plastic such as by injection molding.

FIG. 2 illustrates the manner of securing the attachment to the paint roller 35. Such a paint roller will typically comprise a handle portion 40, a cylindrical pad 45 rotatable about spindle 50, and an arm 55. Both the slotted member 15 and additional attachment member 25 clip onto the arm 55 of the paint roller. Additional attachment member 25 is provided to prevent rotation of the shield about arm 55.

As shown in FIGS. 3 and 4, the plurality of clip means are provided on the shield to allow for repositioning the shield quickly with respect to the paint roller. When a wall surface is to be painted, the roller is attached to slotted member 15 and additional attachment member 25 as shown in FIG. 3. In order to completely shield the roller 45 when a ceiling is to be painted, the shield is fastened to the paint roller by slotted member 17 and attachment member 27 as shown in FIG. 4.

Referring now to FIGS. 5, 6 and 7, there is shown an adapter 60 for use with paint rollers which have an arm portion extending rearwardly at an angle of approximately 45°. FIG. 5 is a perspective view of the adapter 60. It can be seen that the adapter includes a cylindrical section 65 and a slotted portion 70. When in use, as seen in FIG. 6, slotted portion 70 snaps onto arm 55 of the paint roller and cylindrical portion 65 attaches to slotted member 15.

FIG. 7, a section taken generally along the lines 7—7 in FIG. 6, shows that cylindrical portion 65 also includes extended tip 75. Extended tip 75 fits within the slotted member 15 and prevents any rotation of adapter 60 with respect to the shield 10. Adapter 60 may be formed of a molded plastic material.

While the form of apparatus herein described constitutes a preferred embodiment of the invention it is to be understood that the invention is not limited to this precise form of apparatus, and that changes may be made therein without departing from the scope of the invention.

What is claimed is:

1. An attachment for a roller pad paint applicator to prevent splattering of paint during the application by the paint roller, said paint roller having a handle portion, a cylindrical pad rotatable about a spindle, and an arm connecting said spindle to said handle, comprising:

a generally semi-cylindrical plastic shield curved about a central axis, and a plurality of plastic clip means, integrally molded with said plastic shield, for attaching said shield to said arm so that the central axis of said shield is parallel with said spindle, each of said clip means circumferentially displaced with respect to the other clip means, each of said clip means comprising:

a slotted clip member formed integrally with said shield, extending radially from said shield, each slot positioned parallel to the central axis of said semi-cylindrical shield to allow said shield to be adjusted with respect to said paint roller by attaching said shield by individual ones of said clip means to said arm, and an additional clip member positioned on an arcuate edge of said shield for attachment to said arm.

2. An attachment for a roller pad paint applicator to prevent splattering of paint during the application by the paint roller, said paint roller having a handle portion, cylindrical pad rotatable about a spindle, and an arm connecting said spindle to said handle, comprising:

a generally semi-cylindrical shield curved about a central axis, a plurality of clip means for attaching said shield to said arm so that the central axis of said shield is parallel with said spindle, each said clip means including a slotted member formed integrally with said shield, extending radially from said shield, each slot positioned parallel to the central axis of said semi-cylindrical shield to allow said shield to be adjusted with respect to said paint roller by attaching said shield by individual ones of said clip means to said arm, and an adapter means comprising a portion engageable alternatively with each of said clip means and a portion engageable with said arm, for connecting said attachment to said paint roller whereby said attachment may be used with variously configured paint rollers.

* * * * *